US005455972A

United States Patent [19]

Williams

[11] Patent Number: 5,455,972

[45] Date of Patent: Oct. 10, 1995

[54] DISPOSABLE BED PAN BAG AND METHOD OF USING SAME

[75] Inventor: Ruby B. Williams, St. Petersburg, Fla.

[73] Assignee: R. B. Williams Company, St. Petersburg, Fla.

[21] Appl. No.: 280,597

[22] Filed: Jul. 26, 1994

[51] Int. Cl.[6] ..... A61G 9/00

[52] U.S. Cl. ..... 4/452; 4/484

[58] Field of Search ..... 4/452, 484, 450, 4/451, 457, 315

[56] References Cited

U.S. PATENT DOCUMENTS 4,136,798 1/1979 Oberstein ..... 4/452 X
4,882,794 11/1989 Stewart, III ..... 4/452 X

FOREIGN PATENT DOCUMENTS 2243594 11/1991 United Kingdom ..... 4/484

*Primary Examiner*—Robert M. Fetsuga
*Attorney, Agent, or Firm*—Alan Ruderman

[57] ABSTRACT

A bag constructed from synthetic plastic material which is impervious to liquid and other human waste has a pouch bonded to an exterior surface. The pouch has a wall remote from the surface of the bag which is constructed from a material which may be permeated by liquid. Liquid absorbing crystals are disposed between the wall and the surface of the bag. A bed pan may be positioned within the bag and the pouch pushed into the well of the bed pan. Human waste may be deposited onto the surface of the bag and the pouch in conventional manner, and thereafter the bag is turned inside-out as it is removed from the bed pan so that the waste remains within the interior of the inverted bag. The entry to the bag may thereafter be tied closed. The bed pan thus remains free of contact with the waste and need not be cleaned.

7 Claims, 1 Drawing Sheet

DISPOSABLE BED PAN BAG AND METHOD OF USING SAME

BACKGROUND OF THE INVENTION

This invention relates to the sanitary disposal of body waste from an infirm person in a hospital, nursing home or the like, and more particularly to a bag having a fluid absorbing patch or pouch attached to an exterior surface, and the method of using the bag with a bed pan.

In hospitals, nursing homes and similar facilities where persons are bed ridden or infirm, it is customary for such persons to use bed pans when elimination or discharge of body waste is occasioned. After use the bed pan must be emptied and cleaned to alleviate odors and the spread of germs, and to be readied for subsequent use. In many instances, because nurses and aides are busy, emptying and cleaning of the bed pans is frequently postponed. Moreover, when removing the bed pan to a bathroom facility for emptying, spillage occasionally occurs. Such problems have plagued the healthcare industry for a substantial time, but no satisfactory solution has been proposed in the prior art.

SUMMARY OF THE INVENTION

Consequently, it is a primary object of the present invention to provide an article for use in conjunction with a bed pan and a method for using the article with a bed pan whereby body waste does not enter or contact the bed pan and thus the bed pan need not be emptied and cleaned.

It is another object of the present invention to provide a disposable bag within the interior of which a bed pan may be received, the bag having a waste absorbing media on an exterior surface which, when in use, is disposed within the bed pan to absorb body waste deposited therein.

It is a further object of the present invention to provide a disposable bag formed from material which is impervious to liquid and within the interior of which a bed pan may be received, the bag having a pad on an exterior surface thereof, the pad being readily permeated by liquid and containing liquid and moisture absorbent material, the pad being disposed in a faceup disposition when a bed pan is positioned within the bag.

Accordingly, the present invention provides a bag which is constructed from a synthetic plastic material which may not be readily permeated by liquid, or a laminate having such material as a lamination, the bag having an open end for loosely receiving a bed pan. The bag has a pad, patch or pouch bonded or otherwise laminated to an exterior surface which is located at the top of the bed pan during use. The pad, patch or pouch is constructed from material which may be readily permeated by liquid such as the liquid portion of body waste. Crystals or similar particles of a material highly absorbent to liquid and moisture is contained between the pad or patch and the bag while within the pouch.

With the bed pan disposed within the bag and the pad, patch or pouch pushed into the well of the bed pan, the bed pan is used in the usual manner. Body waste permeates the pad, patch or pouch and is absorbed by the absorbent material. Thereafter the bed pan is removed from the bag by turning the bag inside-out so that the pad, patch or pouch is at the interior of the bag and the bed pan remains uncontaminated. The bag with the waste inside may then be closed and be disposed of at a convenient time. Thus, the bed pan need not be cleaned since no waste contacts the pan.

BRIEF DESCRIPTION OF THE DRAWINGS

The particular features and advantages of the invention as well as other objects will become apparent from the following description taken in connection with the accompanying drawings in which.

DESCRIPTION OF THE PREFERRED EMBODIMENT

Figure 1:
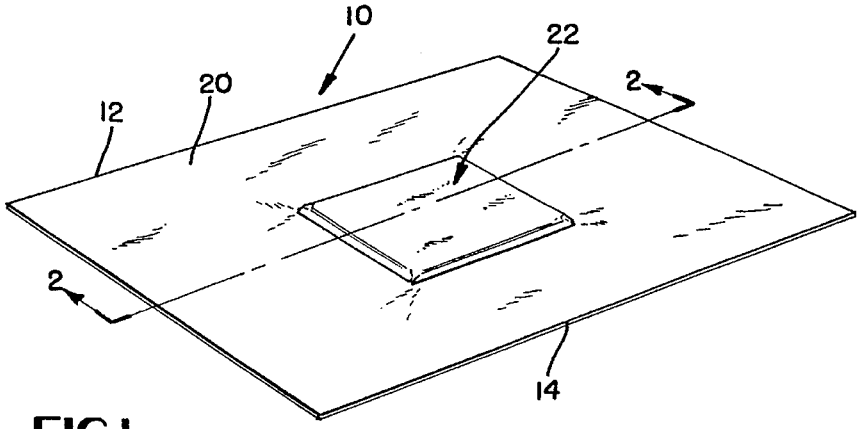
FIG. 1 is a perspective view of a bag in an empty unopened disposition constructed in accordance with the principles of the present invention illustrating a pouch bonded thereto.
Figure 2:
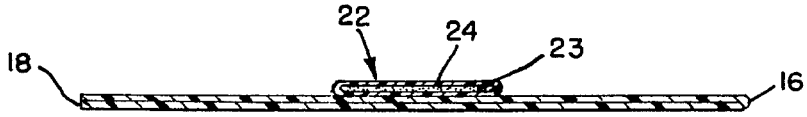
FIG. 2 is a cross sectional view taken along line 2—2 of FIG. 1.

Referring now to the drawings, a bag 10 constructed in accordance with the principles of the present invention has a conventional configuration, larger than a conventional bed pan, sealed at its sides 12, 14 and at one end 16, and is open at the other end 18. The bag may be constructed from polyethylene or other plastic material impervious to or at least not readily permeated by liquid such as urine and the like. However, the bag may be of a laminated construction with the normally exterior surface comprising a laminate formed from a liquid absorbing material such as paper and with the interior laminate constructed from impervious material.

Bonded, glued or otherwise laminated to an exterior surface 20 of the bag 10 at a substantially central disposition is a pouch or pad 22 having at least the wall 24 remote from the surface 20 of the bag constructed from a material which is absorbent to liquid or at least a material which readily may be permeated by liquid. Thus, the pouch 22 or at least the wall 24 may be constructed from absorbent paper or fabric and may be a mesh material such as cheesecloth which may be permeated by liquid. Disposed within the pouch 22 are crystals 23 of a highly absorbent material such as potassium or sodium polyacrylate which is a polymer of an acrylic acid or a polyacylamide, each of which absorbs an extremely large amount of liquid relative to its weight, e.g. in the order of approximately 30 times. Other, albeit less effective materials, including desiccators and other liquid absorbing materials such as silica gel may be used instead of the polyacrylate or polyacylamide. Alternatively, rather than a pouch or pad containing these liquid absorbing crystals, a patch may be bonded or glued to the bag with the crystals disposed between the surface of the bag and the patch, the patch of course is effectively a single wall pouch as is constructed from a liquid permeable material.

Figure 3:
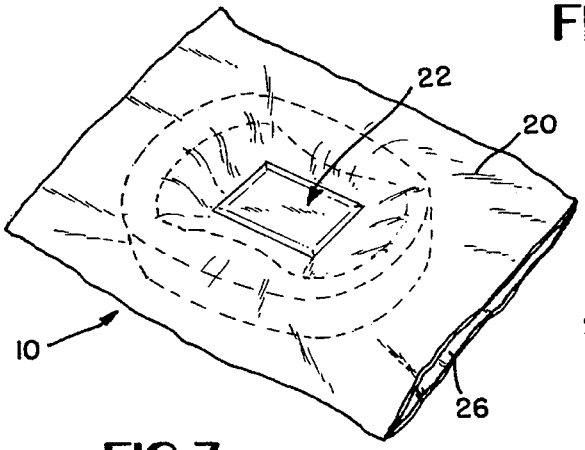
FIG. 3 is a perspective view of the bag with a bed pan disposed therein and with the pouch pressed down into the well at the bottom of the pan.
Figure 4:
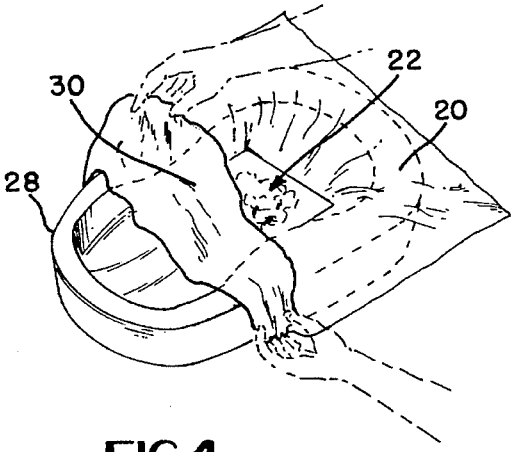
FIG. 4 is a perspective view of the bag as it is being taken off the bed pan after disposable waste has been deposited thereon.
Figure 5:
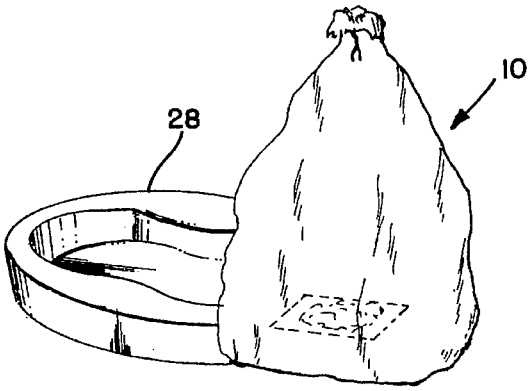
FIG. 5 is a perspective view of the bag removed from the bed pan with the mouth of the bag tied closed.

The manner of using the bag 10 is illustrated in FIGS. 3 through 5. The mouth 26 of the bag is opened and a conventional bed pan 28 having a substantially rectangular configuration with arcuate ends is inserted into the bag with the exterior surface 20 facing upwardly. Thus, the pouch 22 is disposed in an upward facing direction. The pouch 22 and the slack of the bag is then pushed down into the well of the bed pan as illustrated in FIG. 3.

After use of the bed pan in the usual manner by a patient, the bag with its contents absorbed by the pad on the upper surface, is removed from the bed pan by inversing or inverting the bag to the obverse side, i.e., turning the bag inside-out so that the interior surface 30 is pulled over the exterior surface 20 including the pouch 22 as illustrated in FIG. 4. The normally exterior surface 20 together with the pouch is thus now within the inside-out bag and the mouth 26 may be closed and tied as illustrated in FIG. 5. The bed pan 28 thus has not been contacted by any body waste expelled by the patient and remains clean.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A disposable waste receiving bag comprising a pair of spaced apart walls including inner and outer surfaces, said walls having a peripheral configuration and defining a closed end and an open end for receiving a bed pan within the interior thereof between the inner surfaces of said walls, said bag comprising a material substantially impervious to human body waste, a pouch secured to the exterior surface of one of said walls intermediate the ends thereof, said pouch having a wall remote from said exterior surface of said one of said walls comprising a material readily permeated by liquid body waste, and liquid absorbing media disposed in said pouch intermediate said exterior surface of said bag and said wall of said pouch.

2. A disposable waste receiving bag as recited in claim 1, wherein said liquid absorbing media comprises solid crystals.

3. A disposable waste receiving bag as recited in claim 1, wherein said material comprises polyethylene.

4. A disposable waste receiving bag as recited in claim 1, wherein said liquid absorbing media comprises crystals of polyacrylate.

5. A disposable waste receiving bag as recited in claim 1, wherein said liquid absorbing media comprises crystals of a polyacylamide.

6. A method of maintaining a bed pan free of human body waste during utilization of said bed pan by a patient, said method comprising inserting said bed pan into a bag having an open end and spaced apart longitudinally extending walls formed from material that is substantially impervious to human body waste, providing on a surface of one of said longitudinally extending walls of said bag intermediate the ends thereof and external to said pan a pouch having a material readily permeated by liquid body waste and containing a liquid absorbing material, depositing human body waste onto said surface and said pouch, and removing said bed pan from said bag by inversing said bag to reverse the disposition of said surface and said pouch from the exterior of said bag to the interior of said bag, whereby the waste is inside the bag.

7. A method of maintaining a bed pan free of human body waste during utilization of said bed pan by a patient, said method comprising inserting said bed pan into a bag having an open end defining a mouth and a closed end remote from said mouth formed from material that is substantially impervious to human body waste, providing on a surface of said bag external to said pan a pouch having a material readily permeated by liquid body waste and containing a liquid absorbing material, depositing human body waste onto said surface and said pouch, and removing said bed pan from said bag by inversing said bag to reverse the disposition of said surface and said pouch from the exterior of said bag to the interior of said bag, said inversing of said bag comprising drawing said mouth over said bed pan and said closed end, whereby the waste is inside the bag.

* * * * *